United States Patent [19]

Martin

[11] 4,362,517

[45] Dec. 7, 1982

[54] INFLATABLE LIFERAFTS

[75] Inventor: Michael D. Martin, Liphook, England

[73] Assignee: RFD Inflatables Limited, Surrey, England

[21] Appl. No.: 198,174

[22] Filed: Oct. 17, 1980

[30] Foreign Application Priority Data

Oct. 18, 1979 [GB] United Kingdom ..... 7936193

[51] Int. Cl.[3] ..... B63C 9/22

[52] U.S. Cl. ..... 441/41; 441/42

[58] Field of Search ..... 441/35, 38, 40–42; 114/345

[56] References Cited

U.S. PATENT DOCUMENTS 2,216,871 10/1940 Banks et al. ..... 9/11 A
3,308,494 3/1967 Licher ..... 9/317
3,682,354 8/1972 Witte ..... 9/317
4,063,323 12/1977 Salvarezza ..... 9/316

FOREIGN PATENT DOCUMENTS 560492 7/1958 Canada ..... 9/11 A
891300 3/1962 United Kingdom .

*Primary Examiner*—Sherman D. Basinger
*Attorney, Agent, or Firm*—Birch, Stewart, Kolasch & Birch

[57] ABSTRACT

An inflatable liferaft comprising a pressurized air or gas inflation unit, an elongate flexible support connected between a point of attachment on the liferaft and the inflation unit for supporting the inflation unit at a position remote from the point of attachment and carrying an air or gas flexible supply line or lines from the inflation unit to the liferaft, whereby during inflation of the liferaft the point of attachment has freedom to move relative to the inflation unit.

12 Claims, 2 Drawing Figures

INFLATABLE LIFERAFTS

The present invention relates to inflatable liferafts and is particularly, although not exclusively, concerned with an inflatable liferaft which is stowed in a deflated and folded condition in a container and which is inflated from pressurised air or gas inflation cylinders attached to the liferaft and packed with it within the container.

It has been common practice to mount the inflation cylinders on the underside of the liferaft and so arrange the packing of the liferaft within the container that the inflation cylinders are lowermost. Provision is made for opening the cylinders for inflation of the liferaft either automatically upon entry of the container into the water or manually by pulling on a pull cord extending from the container. Pulling on the pull cord initiates inflation of the liferaft causing it to break out of the container. As it inflates fully the container fills with water and sinks away from the liferaft.

It has been proposed to provide for two 42 person liferafts to be stowed in a deflated condition in a single container so as to form an 84 person survival unit. The two liferafts are packed side by side in the container with their inflation cylinders lowermost and provision is made for opening the inflation cylinders simultaneously by operating a single pull cord extending from the container. It has, however, been found that with the containers mounted on the underside of the liferaft conditions are likely to arise in which the inflation cylinders get caught up and wedged against the wall of the container as the two liferafts inflate and push each other apart on the surface of the water.

It is an object of the present invention to provide an inflatable liferaft which does not suffer from the disadvantage referred to above when stowed as aforesaid as one of a pair in a single container.

According to the present invention, there is provided an inflatable liferaft comprising a pressurised air or gas inflation unit, elongate flexible support means connected between a point of attachment on the liferaft and the inflation unit for supporting the inflation unit at a position remote from the point of attachment and carrying an air or gas flexible supply line or lines from the inflation unit to the liferaft, whereby during inflation of the liferaft the point of attachment has freedom to move relative to the inflation unit.

Preferably, the inflation unit comprises one or more pressurised air or gas inflation cylinders stowed in a holder and the flexible support means comprises a flexible tube through which the air or gas supply line or lines pass and which is secured at one end to the holder and at the other end to the point of attachment on the liferaft at a strongpoint thereon.

One embodiment of the invention will now be described by way of example with reference to the accompanying drawings:-

Figure 1:
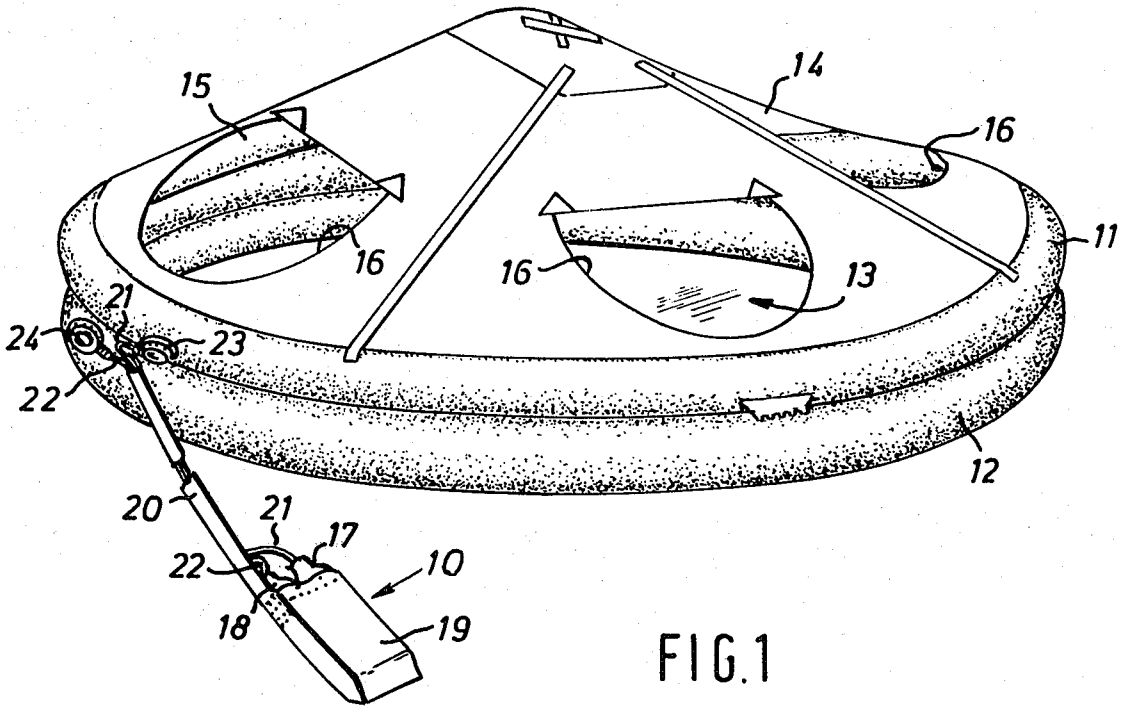
Figure 2:
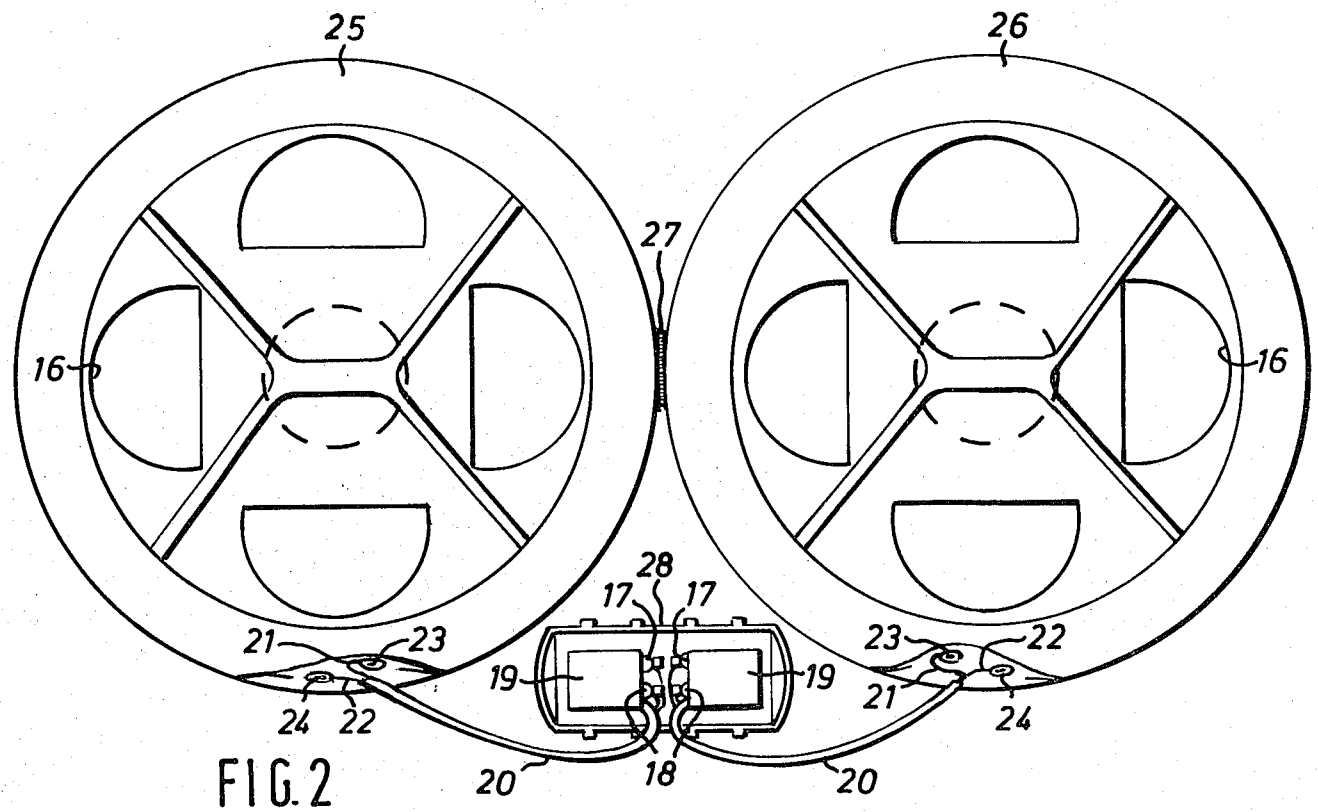

FIG. 1 is a perspective view of an inflatable liferaft according to the invention, and FIG. 2 is a schematic plan view of a survival unit during inflation and comprising two liferafts as shown in FIG. 1.

Referring first to FIG. 1 of the drawings, the liferaft shown comprises two superposed endless inflatable buoyancy tubes 11 and 12, a floor 13 which is secured at its periphery to the base of the lower buoyancy tube 12 and a canopy 14 secured at its periphery to the upper buoyancy tube 11 and supported by a canopy support structure formed by a pair of inflatable arched canopy support tubes 15, each of which has two leg portions extending upwardly and inwardly from spaced positions along the buoyancy tube 11 to the center of the liferaft where they are joined by a bridge portion which is juxtaposed to a bridge portion of the other arched tube, the leg portions of which extend upwardly and inwardly from spaced positions on the other side of the liferaft. One leg portion 15 of one of the canopy support tubes is revealed in FIG. 1 through one of four openings 16 provided in the canopy 14. The openings 16 are formed in the canopy 14 at equi-angularly spaced positions around the liferaft and each is closable by a closure sheet (not shown). The interiors of the two buoyancy tubes 11 and 12 have no communication with each other and are arranged to be inflated separately. One of the arched canopy support tubes is arranged to be inflated from inflation air supplied to the buoyancy tube 11 while the other canopy support tube is arranged to be inflated by the lower buoyancy tube 12.

An inflation unit 10 for inflation of the buoyancy tubes 11 and 12 and their associated canopy support tubes comprises two pressurised nitrogen inflation cylinders 17 and 18 housed in a holder 19 secured to the liferaft by a flexible inextensible tube 20, one end of which is attached to the holder 19 and the other end of which is secured to a strong point on the lower buoyancy tube 12. High pressure small bore supply hoses 21 and 22 extend from the cylinder outlets through the tube 20 to aspirators 23 and 24 carried by the buoyancy tubes 11 and 12. The inflation cylinders 17 and 18 are arranged to be opened either automatically or manually by pulling on a pull cord (not shown). The pressurised nitrogen supplied to the hoses 21 and 22 is fed into the buoyancy tubes 11 and 12 via the aspirators 23 and 24 which supplement the nitrogen fed thereto by entraining ambient air. The length of the tube 20 is such in relation to the length of the hoses 21 and 22 as to absorb any tensile loads which might otherwise be imposed on the hoses in use of the liferaft.

The liferaft shown in FIG. 1 has a service capacity of 43 persons with an outside diameter of 5.28 meters, an inside diameter of 4.46 meters and an overall height of 1.80 meters. For a liferaft of this capacity each inflation cylinder may contain air or nitrogen at 3000 p.s.i.

It has been found advantageous to provide a survival unit in which two 42-person liferafts as shown in FIG. 1 are coupled together to offer a total service capacity of 84 persons. The two liferafts together with their inflation units 10 are stowed in a deflated and folded condition in a cylindrical container formed by two semi-cylindrical half shells which are held together by straps which give way under loading imposed upon them by initial inflation of the liferafts in the container.

Referring now to FIG. 2, two coupled liferafts 25 and 26, shown inflated in FIG. 2, are packed in a deflated and folded condition on top of their inflation units 10 in the lower-most half shell 28 of their container which is closed by fitting the other half shell (not shown) to the half shell 28 and securing them together by straps as hereinbefore described.

Actuation of the inflation cylinders 17 and 18 of the two inflation units 10 is obtained by pulling on a single pull cord (not shown) extending from the container and, in use, the container housing the two liferafts 25 and 26 is dropped into the water and the cord pulled hard. Nitrogen discharges from the cylinders 17 and 18 and via the aspirators into the buoyancy tubes 11 and 12 of the two liferafts causing them to inflate. During the initial stages of inflation, the liferafts 25 and 26 expand within the container and break the straps holding the two half shells of the container together. The liferafts 25 and 26 then inflate out of the container and are held in coupled side-by-side relation by a releasable attachment 27, as shown in FIG. 2. During inflation, the points of attachment of the tubes 20 to the two liferafts 25 and 26 are forced away from each other and from the container half shell 28. The inflation units 10, however, remain within the half shell 28 and by virtue of the length of the flexible hoses 21 and 22 and their support tubes 20 cause no obstruction to the inflation of the liferafts on the water. The inflation units remain in the half shell 28 until the latter fills with water and sinks.

The aspirators 23 and 24 are inoperative until they are above water level, whereupon they take in ambient air to boost the high pressure air or gas from the cylinders. In this way, rapid inflation is achieved in less than 30 seconds. After the inflation cylinders 17 and 18 have become discharged, the air intakes on the aspirators 23 and 24 automatically close and are locked in the closed position. The attachment 27 can, if desired, be released by a simple action of a survivor to allow separation of the two liferafts.

I claim:

1. A survival unit, comprising:

a container; two inflatable liferafts coupled together on the respective peripheries thereof capable of being housed in said container in a deflated and folded condition, each of said liferafts being connected with a pressurized air or gas inflation unit; a flexible air or gas supply line or lines connecting said inflation unit to said liferaft; an elongate flexible support means for connecting a point of attachment at said liferaft with said inflation unit, said elongate flexible support means supporting the inflation unit at a position remote from the point of attachment, supporting the flexible air or gas supply line or lines, and absorbing any tensile load which might otherwise be imposed on said supply line or lines during use of said liferafts; and wherein upon inflation out of said container, the two liferafts take up fully inflated dispositions on the water, the length of said flexible support means and said air or gas supply line or lines and their respective points of attachment to the liferafts being such that the two liferafts take up fully inflated dispositions on the water without the need for withdrawal of the inflation units from the container.

2. A survival unit according to claim 1, wherein each inflation unit comprises one or more pressurized air or gas inflation cylinders stored in a holder and wherein each flexible support means comprises a flexible tube through which the air or gas supply line or lines passes and which is secured at one end to the holder and at the other end to the point of attachment on the liferaft at a strong point thereon.

3. A survival unit according to claim 1, wherein the inflation units are so arranged as to be lowermost in the container and remain in the container during deployment in water and during inflation of the two liferafts out of the container.

4. A survival unit according to claim 3, wherein the inflation units are free to withdraw from the container when the container fills with water and sinks.

5. A survival unit according to claim 2, wherein the liferafts are of circular configuration and wherein the points of attachment of the flexible support means to the liferafts are spaced from the coupling points of the liferafts.

6. A survival unit, comprising:

a liferaft container; two inflatable liferafts coupled together on the respective peripheries thereof capable of being housed in said container in a deflated and folded condition, each of said liferafts being connected with a pressurized air or gas inflation unit containing one or more air or gas inflation cylinders stored in a holder; a flexible air or gas supply line or lines operably connecting said inflation unit with said liferaft; an elongate flexible support tube connected at one end thereof with said liferaft at a point of attachment and connected at the other end thereof with said inflation unit, said flexible air or gas supply line or lines being arranged to pass through said flexible support tube, the length of said tube in relation to said air or gas supply line or lines being such as to absorb any tensile loads which might otherwise be imposed on said line or lines during the use of said liferafts wherein upon inflation out of said container the two liferafts take up fully inflated dispositons on the water, the length of said flexible support tubes and said air or gas supply line or lines and their respective points of attachment to the liferaft being such that the two liferafts can take up fully inflated dispositions on the water without the need for withdrawal of the inflation units from the container.

7. A survival unit according to claim 6, wherein said inflation units are arranged in the lowermost portion of said container and remain in said container during deployment in water and during inflation of said liferafts out of said container.

8. A survival unit according to claim 6, wherein said inflation units are free to withdraw from said container when said container fills with water and sinks.

9. A survival unit according to claim 6, wherein said liferafts are of circular configuration and wherein the points of attachment of said flexible support tubes to said liferafts are spaced from the coupling point of said liferafts.

10. A survival unit according to claim 6, wherein each of said liferafts comprises an upper and lower buoyancy tube and said support tube is attached to said lower buoyancy tube.

11. A survival unit according to claim 6, wherein said support tube is inextensible.

12. A survival unit according to claim 6, wherein said flexible air or gas supply line or lines pass through the end of said flexible support tube at said point of attachment with said liferaft for connection with said liferaft.

* * * * *